US005801610A

United States Patent [19]

Levin

[11] Patent Number: 5,801,610

[45] Date of Patent: Sep. 1, 1998

[54] PHASE SHIFTING TRANSFORMER WITH LOW ZERO PHASE SEQUENCE IMPEDANCE

[76] Inventor: Michael I. Levin, 33 Bayhampton Court, North York, Ontario, Canada, M3H 5L5

[21] Appl. No.: 230,466

[22] Filed: Apr. 20, 1994

[51] Int. Cl.[6] ..... H01F 33/00

[52] U.S. Cl. ..... 336/12

[58] Field of Search ..... 336/5, 12, 15, 336/137, 145, 148, 170, 180, 182, 183, 184, 218

[56] References Cited

U.S. PATENT DOCUMENTS

| | | | |
|---|---|---|---|
| 1,159,228 | 11/1915 | Keidel et al. | 336/10 |
| 1,814,557 | 7/1931 | Jonas | 307/13 |
| 1,953,233 | 4/1934 | Jonas | 172/237 |
| 2,212,399 | 8/1940 | Köchling | 171/97 |
| 2,312,571 | 3/1943 | Meyer | 171/97 |
| 2,357,995 | 7/1944 | Blomberg et al. | 177/352 |
| 2,560,385 | 2/1951 | Dessarzin | 323/45 |
| 3,504,318 | 3/1970 | Wilburn et al. | 336/12 |
| 4,531,085 | 7/1985 | Mesenhimer | 323/214 |
| 4,812,669 | 3/1989 | Takeda et al. | 307/105 |
| 4,896,092 | 1/1990 | Flynn | 323/258 |
| 4,967,334 | 10/1990 | Cook et al. | 363/34 |
| 5,206,539 | 4/1993 | Kammeter | 307/105 |
| 5,331,303 | 7/1994 | Shiota | 336/12 |

FOREIGN PATENT DOCUMENTS

| | | | |
|---|---|---|---|
| 1408359 | 7/1965 | France | 336/5 |
| 0258438 | 4/1913 | Germany | 336/12 |

OTHER PUBLICATIONS

Robert H. Lee, "Eliminating Harmonic Currents Using Transformers": Power Quality; Sep./Oct., 1991; pp. 33–37.

Prem P. Khera, "Application of Zigzag Transformers for Reducing . . . System"; ©IEEE, 1990.

*Primary Examiner*—Hyung S. Sough

[57] ABSTRACT

A phase shifting transformer or autotransformer for a three phase power distribution network has a secondary winding including a plurality of windings distributed amongst the three core legs such that on each core leg the number of turns of windings generating a flux in the positive direction is substantially equal to the number of turns of windings generating a flux in the negative direction. Thus, according to the invention, the transformer may be provided with any necessary phase shifting angles between different harmonic sources, with outputs each having a very low zero phase sequence impedance to reduce voltage distortion created by zero phase sequence harmonics.

24 Claims, 3 Drawing Sheets

PHASE SHIFTING TRANSFORMER WITH LOW ZERO PHASE SEQUENCE IMPEDANCE

FIELD OF INVENTION

This invention relates to transformers and autotransformers for electrical distribution systems. In particular, this invention relates to a three-phase phase-shifting transformer or autotransformer which reduces voltage distortion caused by zero phase sequence and conventional harmonic currents.

BACKGROUND OF THE INVENTION

Three-phase electrical distribution networks, for example distributing an electrical power supply through a building, are subject to harmonic currents generated by non-linear loads such as electronic equipment and equipment that uses different kinds of arc processes. Such equipment can generate excessive harmonic currents in the distribution network, including zero phase sequence (triplen) harmonics (3rd, 9th etc.) and conventional harmonics (5th, 7th, 11th, 13th etc.).

Zero phase sequence harmonics, together with unbalanced portions of the fundamental and other harmonic currents, are additive in the neutral conductor, which can result in cumulative currents well in excess of the anticipated phase currents and overload the neutral conductor, which is not protected. In addition to the possibility of overload, these harmonics result in high common-mode noise level (neutral to ground voltage), increased total harmonic distortion level, voltage imbalance, increased power losses and other problems which are well known.

Different kinds of L-C filters can be used in low voltage systems, tuned to different harmonic frequencies. These devices present problems which are well known.

In a three-phase distribution network, zero phase sequence harmonics are conventionally controlled using zero phase sequence filters. Such filters, for example so-called "zig-zag" reactors, have a low impedance to zero phase sequence currents, and as such serve to attract these currents and effectively divert them from the distribution network. Because the two windings on each core leg have opposite polarities the zero phase sequence current fluxes generated by the windings on any particular core leg are opposite and therefore cancel. However, such filters do not reduce levels of conventional harmonics.

Different kinds of phase shifters are available which allow the creation of quasi-multiphase systems, reducing certain harmonic levels. Cancellation of certain harmonic currents generated by different loads depends upon the degree of phase shifting. However, these devices have a relatively high zero phase sequence impedance, and accordingly do not reduce distortion levels created by zero phase sequence harmonics.

Combined zero phase sequence filters have recently become available, which reduce zero phase sequence harmonics and, by virtue of a 30° phase shift between the line and load sides of the filter, cancel or reduce 5th, 7th, 17th, 19th etc. harmonics. However, such devices do not reduce levels of 11th, 13th etc. harmonics. Moreover, this type of filter is directional, in that it has different impedances on different outputs; while this feature may be advantageous in some applications, in general it is preferable to have the lowest possible zero phase sequence impedance on all outputs.

The present invention overcomes these disadvantages by providing a three-phase phase shifting transformer or autotransformer with low zero phase sequence impedance. This is accomplished by interconnecting multiple windings in a secondary such that for each leg of the magnetic core the ampere-turns of windings creating fluxes in the positive direction are equal to the ampere-turns of windings creating fluxes in the negative direction. Thus, the present invention is able to create any necessary phase shifting angles between different harmonic sources, with outputs each having a very low zero phase sequence impedance so that the invention also acts as a zero phase sequence current filter. This significantly decreases power losses, partly because the cancellation of zero phase sequence fluxes in the core substantially reduces induced zero phase sequence harmonics in the primary, which reduces energy usage, avoids overheating and decreases voltage distortion.

These and other advantages will be apparent from the description of the invention which follows.

SUMMARY OF THE INVENTION

The present invention thus provides a phase shifting transformer or autotransformer for a three-phase power distribution network, comprising three core legs, and for each phase, a secondary winding comprising a plurality of windings distributed amongst the core legs, having at least one output for connection to one phase of the power distribution network, wherein on each core leg the number of turns of windings generating a flux in the positive direction is substantially equal to the number of turns of windings generating a flux in the negative direction.

BRIEF DESCRIPTION OF THE DRAWINGS

In drawings which illustrate by way of example only a preferred embodiment of the invention.

DETAILED DESCRIPTION OF THE INVENTION

The present invention provides a phase shifting transformer or autotransformer which also acts as a zero phase sequence current filter. For example, a transformer or autotransformer according to the present invention can be designed to provide a 30° phase shift between two outputs by providing a 15° leading phase displacement to one output and a 15° lagging phase displacement to the other output. In each case multiple windings are arranged on the core legs such that, for each phase, the sum of the positive phase sequence flux vectors generated by windings connected in series results in the desired voltage and phase displacement. At the same time, the size (number of turns) of the windings and their placement and orientation on each core leg is such that, for each core leg, the total number of turns generating zero phase sequence flux in the positive direction equals the total number of turns generating zero phase sequence flux in the negative direction. Thus, according to this arrangement, the phase displacement results in cancellation of conventional harmonics and the distribution and orientation of the windings significantly reduces voltage distortion created by zero phase sequence harmonics.

Figure 1:
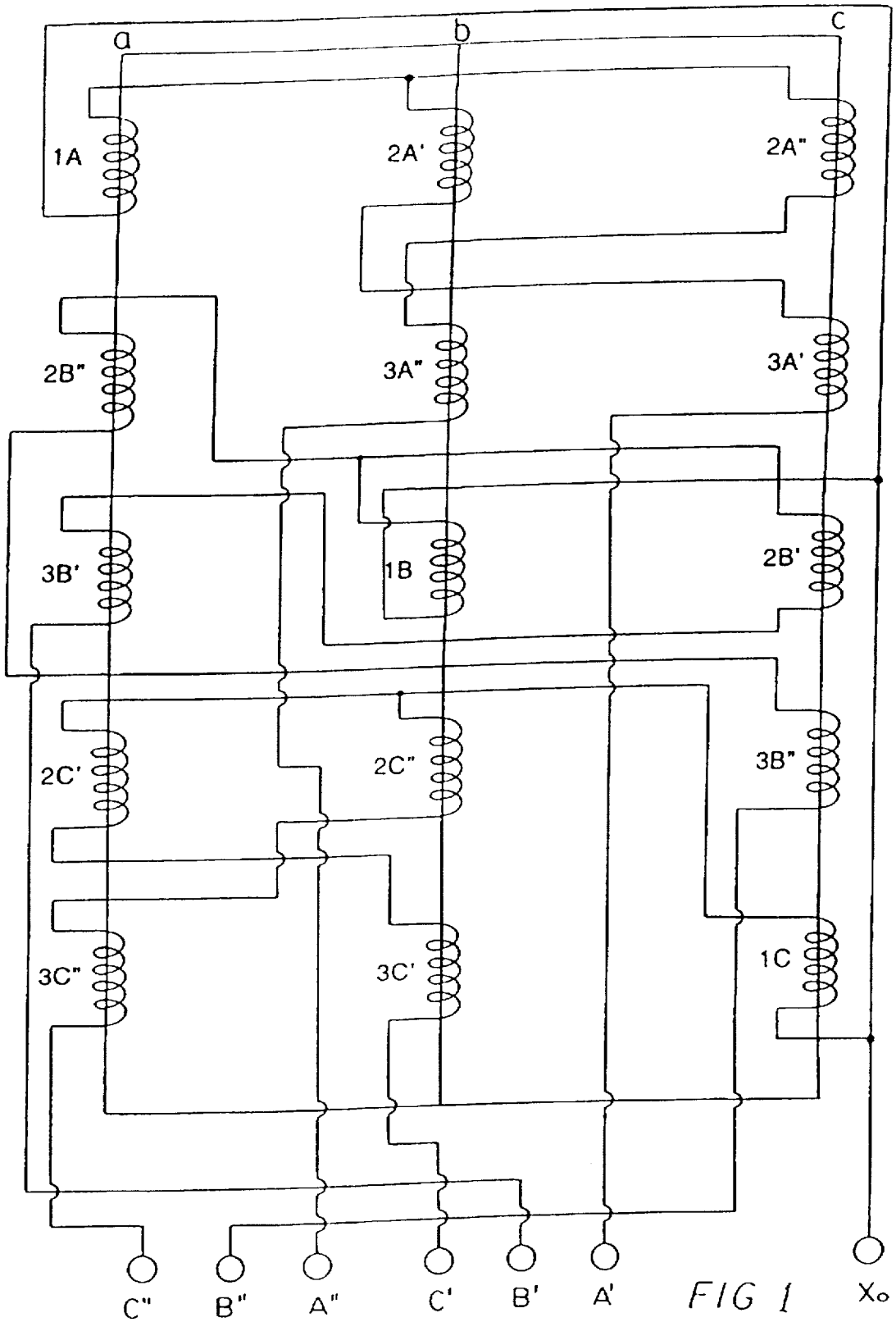
FIG. 1 is a schematic diagram of a transformer secondary embodying the invention with two outputs.

FIG. 1 illustrates a secondary for the transformer or autotransformer of the invention, having two three-phase outputs A',B',C' and A",B",C" provided with a 30° phase shift to reduce conventional (5th, 7th, 17th, 19th etc.) harmonic currents, and at the same time significantly reducing distortion created by zero phase sequence harmonics. The primary (not shown) may be of a conventional delta or star configuration. It will be appreciated that the invention is operable in both transformers and autotransformers, and although the description of the preferred embodiments refers to transformers by way of example, the construction and operating principles of the invention are equally applicable to autotransformers.

As illustrated in FIG. 1, the transformer secondary comprises a magnetic core having three core legs a,b,and c magnetically coupled to the primary in conventional fashion. Each core leg a,b,c is provided with a plurality of windings. The windings for each phase are connected in series, the orientation and number of turns of each winding being designed according to the phase shift sought to be achieved, which in turn depends upon the harmonic currents sought to be reduced or eliminated. In the embodiment illustrated a phase displacement of 15° to each output results in a net phase shift of 30° as between the two outputs.

Figure 2:
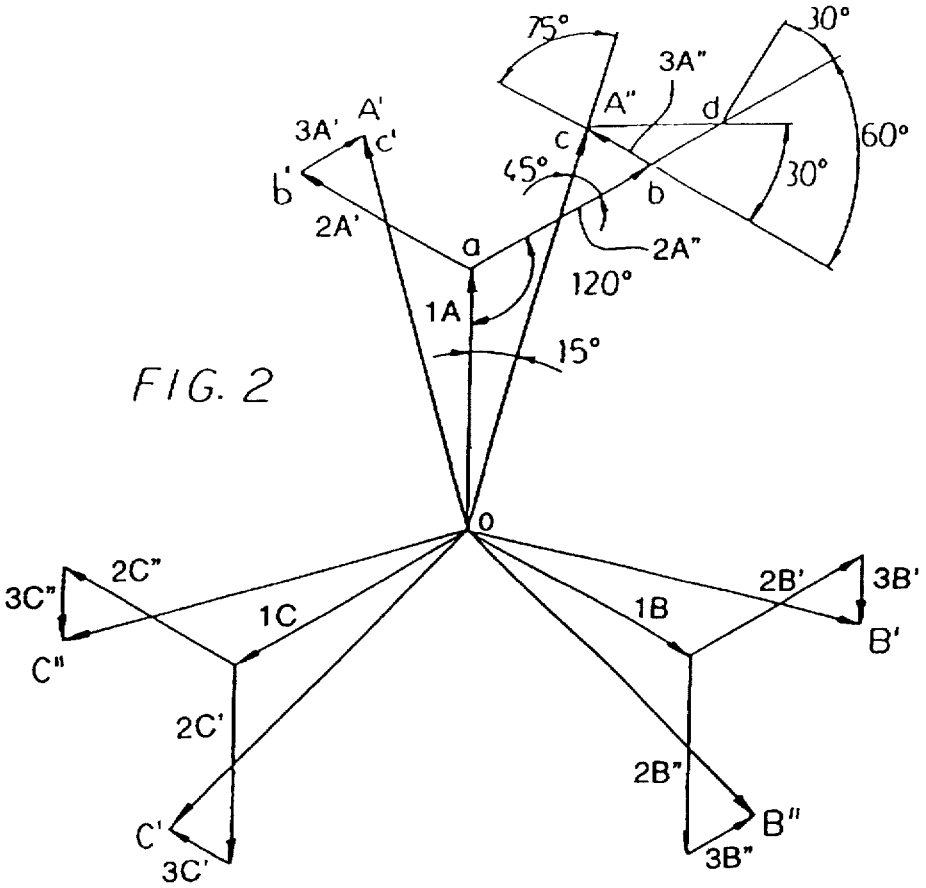
FIG. 2 is a vector diagram illustrating the e.m.f. of the transformer secondary of FIG. 1.

FIG. 2 is a vector diagram of the secondary for the phase shifting transformer (or autotransformer) of FIG. 1. The resultant vectors oA' and oA", oB' and oB", and oC' and oC" in FIG. 2 are the respective sums of the elementary vectors generated by each winding. The elementary flux vectors represent the intensity and direction of flux produced by the corresponding windings of FIG. 1. FIG. 1 includes designations of the windings corresponding to elementary vectors oa,ab,bc and oa,ab' and b'c' by way of example.

Thus, as illustrated in FIG. 1, windings 1A, 2A' and 3A' are connected in series to produce output A'; windings 1A, 2A" and 3A" are connected in series to produce output A"; windings 1B, 2B' and 3B' are connected in series to produce output B'; windings 1B, 2B" and 3B" are connected in series to output B"; windings 1C, 2C' and 3C' are connected in series to produce output C'; and windings 1C, 2C" and 3C" are connected in series to produce output C". The flux vectors in FIG. 2 are correspondingly numbered.

In the embodiment illustrated a single winding 1A, 1B, or 1C is used for the initial elementary vector producing both outputs. For example, vector oa is produced by a single winding designated 1A connected to two windings designated 2A' and 2A" to produce two separate outputs. In other words, the winding 1A is common to both outputs A' and A". It will be appreciated that two electrically independent windings could be used to produce vector oa, one winding connected to winding 2A" and the other connected to winding 2A', with exactly the same result but at a slight additional cost.

As is well known, the length of each flux vector is directly proportional to the number of ampere-turns in the corresponding winding, and the orientation of each flux vector is determined by the phase to which it is connected and the physical orientation of the winding on the core leg.

Thus, in order to obtain a phase shift of 30° between resultant vectors oA' and oA", the resultant vector oA" is phase shifted 15° leading and the resultant vector oA' is phase shifted 15° lagging. The windings are of a size (number of turns) and orientation such that the sum of the elementary flux vectors oa+ab+bc equals the resultant vector oA" and the sum of the elementary flux vectors oa+ab'+b'c' equals the resultant vector oA'. This equation applies equally to the resultant vectors oB",oB' and oC",oC'.

The elementary flux vectors being generated by each of the three phases, are limited to six directions: 0°, 60°, 120°, 180°, 240° and 300° (or, for purposes of simplicity, 0, +/−60°, +/−120° and 180°). The size (number of turns n) of each winding determines the length of the vector. The phase connection and its orientation on the core leg determines its direction.

The selection of possible combinations and permutations of flux vectors which will create each resultant vector, and thus achieve the desired phase shift to reduce conventional harmonic currents, is virtually unlimited. In order to significantly reduce or substantially eliminate zero phase sequence harmonic distortion at the same time, the sizes, orientations and locations of the windings on the core are also selected so that for each core leg the total number of turns creating fluxes in the positive direction is equal to the total number of turns creating fluxes in the negative direction.

Thus, the following equations are solved to produce a transformer represented by the vector diagram of FIG. 2:

$$V_{oa}=V_{ab}+V_{bc}$$

$$V_{cd}=2V^{bc}\cos 30°$$

$$V=V_{oa}\cos 15°+V_{ab}\cos 45°+V_{bc}\cos 75°$$

$$V_{od}=V\cos 15°+V_{cd}\cos 60°$$

$$V_{od}=2V_{oa}\cos 30°$$

Figure 3:
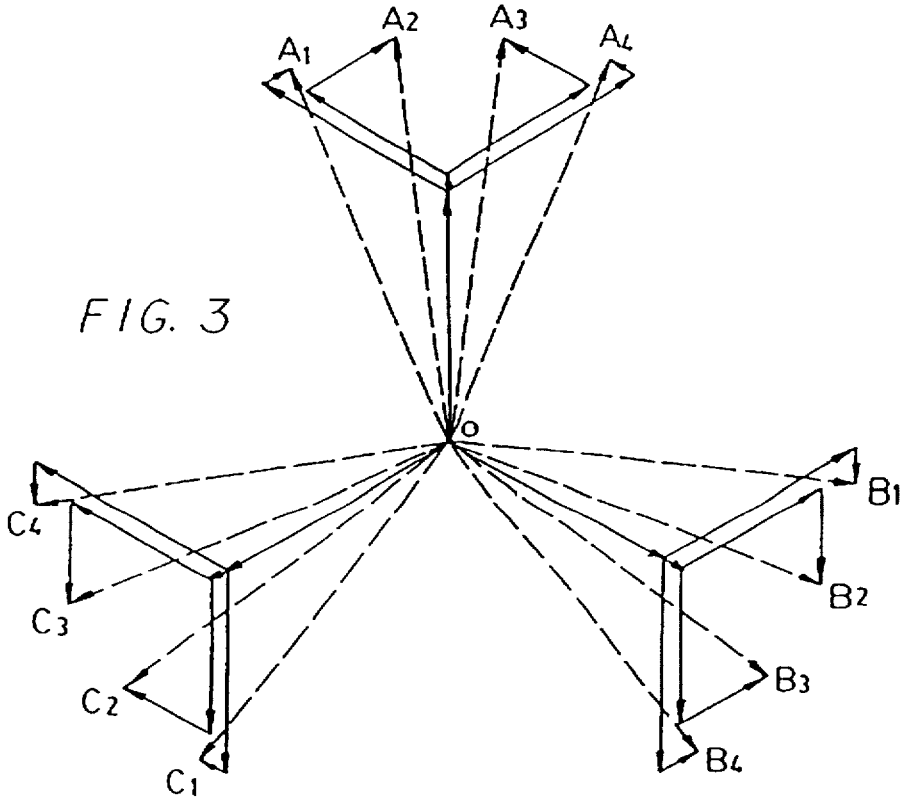
FIG. 3 is a vector diagram illustrating the e.m.f. of a transformer secondary embodying the invention with four outputs.

FIG. 3 illustrates an embodiment of the invention having four outputs. In this embodiment, resultant vectors $oA_2$ and $oA_3$ are phase shifted 15° relative to each other, based on lagging and leading phase displacements of 7.5°, respectively. Resultant vector $oA_1$ is phase shifted 15° (lagging) relative to vector $oA_2$, and resultant vector $oA_4$ is phase shifted 15° (leading) relative to vector $oA_3$. The result is a four-output phase shifting transformer (or autotransformer) which cancels conventional (5th, 7th, 11th, 13th, 17th, 19th, etc.) harmonics and significantly reduces distortion caused by zero phase sequence harmonics.

Figure 4:
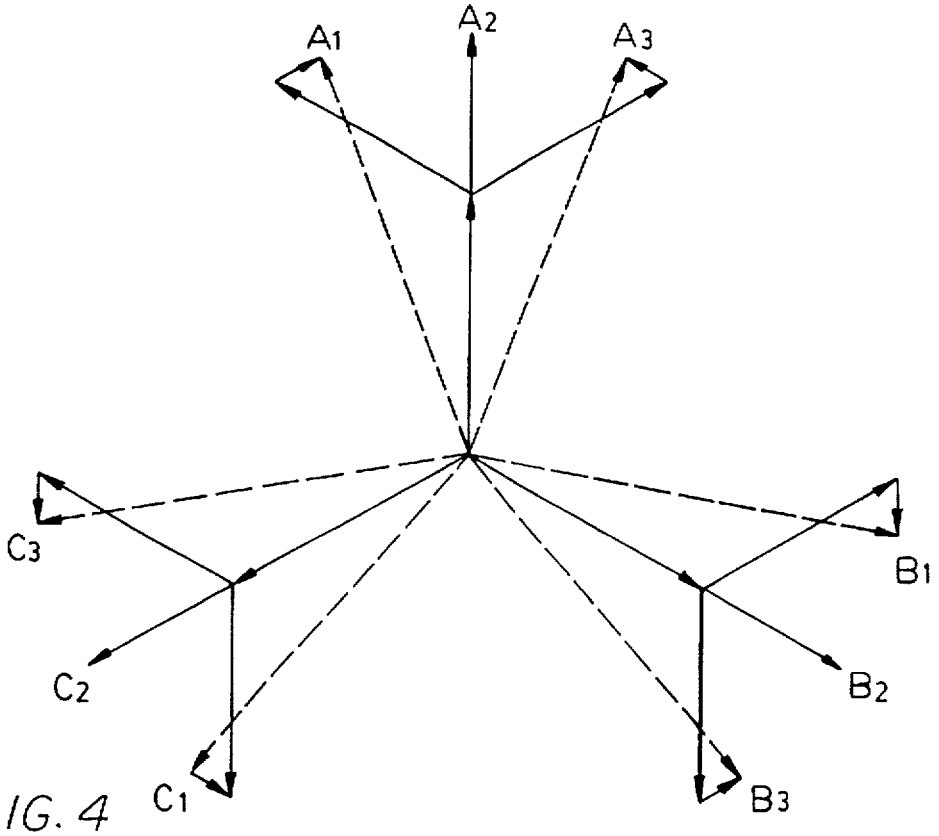
FIG. 4 is a vector diagram illustrating the e.m.f. of a transformer secondary having three 20° phase shift angle outputs wit low levels of zero phase sequence impedance in the leading and lagging outputs.
Figure 5:
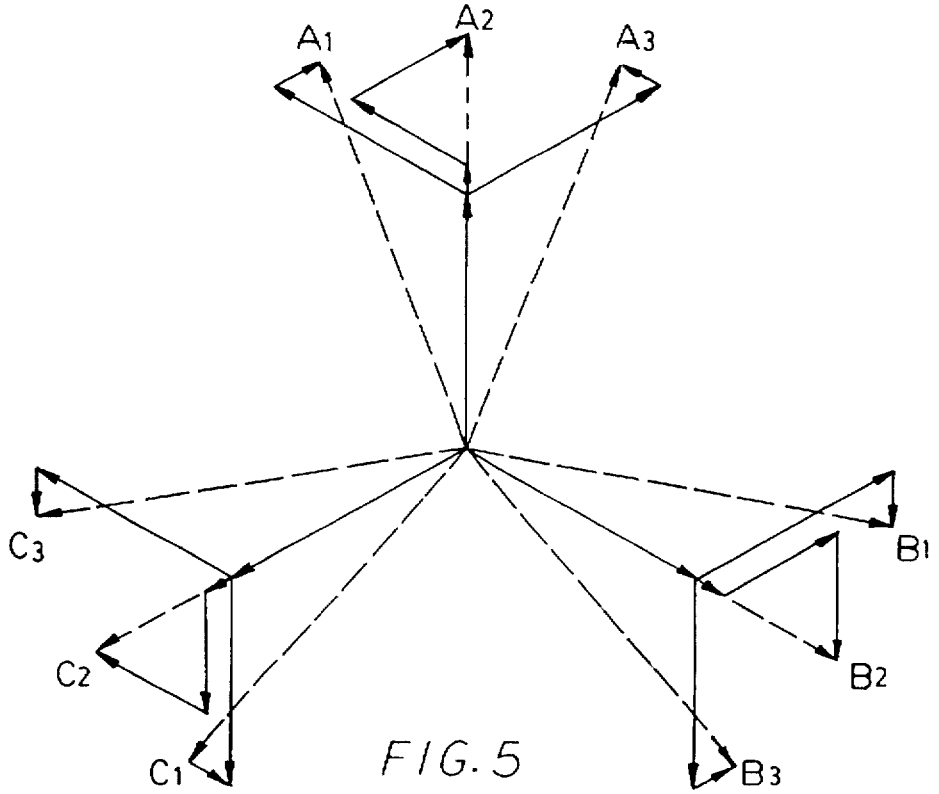
FIG. 5 is a vector diagram illustrating the e.m.f. of a transformer secondary having three 20° phase shift angle outputs with each output having a low zero phase sequence impedance.

FIG. 4 illustrates a further embodiment of the invention having three 20° phase shift angle outputs, with low levels of zero phase sequence impedance on outputs $A_1$, $A_3$, $B_1$, $B_3$, $C_1$ and $C_3$. FIG. 5 illustrates a variation of the transformer of FIG. 4, in which the central outputs $A_2$, $B_2$ and $C_2$ also have a low zero phase sequence impedance. This is accomplished by a simple redistribution of windings on the core legs in accordance with the invention, as described above.

The invention having thus been described with reference to a preferred embodiment, it will be apparent to those skilled in the art that certain modifications and adaptations may be made without departing from the scope of invention, as set out in the appended claims.

I claim:

1. A phase shifting transformer or autotransformer for a three-phase power distribution network, comprising three core legs, and for each phase, a secondary winding comprising a plurality of windings electrically connected in series and distributed amongst the core legs, each secondary winding having at least two phase shifted outputs for connection to one phase of the power distribution network such that at least one output is associated with at least one winding on each core leg, wherein on each core leg the number of turns of windings oriented in one direction is substantially equal to the number of turns of windings oriented in an opposite direction.

2. The phase shifting transformer or autotransformer of claim 1 wherein the secondary winding for each phase has two outputs.

3. The phase shifting transformer or autotransformer of claim 1 wherein the secondary winding for each phase has four outputs.

4. The phase shifting transformer or autotransformer of claim 2 wherein all of the outputs have a low zero phase sequence impedance.

5. The phase shifting transformer or autotransformer of claim 3 wherein all of the outputs have a low zero phase sequence impedance.

6. The phase shifting transformer or autotransformer of claim 1 wherein the secondary windings associated with each output are electrically independent.

7. The phase shifting transformer or autotransformer of claim 1 wherein two or more outputs share a common winding.

8. The phase shifting transformer or autotransformer of claim 1 wherein the secondary winding for each phase has three outputs.

9. The phase shifting transformer or autotransformer of claim 8 wherein all of the outputs have a low zero phase sequence impedance.

10. A phase shifting transformer or autotransformer for a three-phase power distribution network, comprising three core legs, and for each phase, a secondary winding having at least two phase shifted outputs for connection to one phase of the power distribution network, each secondary winding comprising a plurality of windings electrically connected in series and distributed amongst the core legs such that for at least one output each core leg is provided with at least one winding associated with said at least one output, wherein on each core leg the number of turns of windings oriented in one direction is substantially equal to the number of turns of windings oriented in an opposite direction to thereby substantially cancel zero phase sequence harmonics generated by the windings on each core leg.

11. The phase shifting transformer or autotransformer of claim 10 wherein the secondary winding for each phase has two outputs.

12. The phase shifting transformer or autotransformer of claim 10 wherein the secondary winding for each phase has three outputs.

13. The phase shifting transformer or autotransformer of claim 10 wherein the secondary winding for each phase has four outputs.

14. The phase shifting transformer or autotransformer of claim 11 wherein all of the outputs have a low zero phase sequence impedance.

15. The phase shifting transformer or autotransformer of claim 12 wherein all of the outputs have a low zero phase sequence impedance.

16. The phase shifting transformer or autotransformer of claim 13 wherein all of the outputs have a low zero phase sequence impedance.

17. The phase shifting transformer or autotransformer of claim 10 wherein the windings associated with each output are electrically independent.

18. The phase shifting transformer or autotransformer of claim 10 wherein two or more outputs share a common winding.

19. The phase shifting transformer of claim 1 in which each core leg is provided with at least one winding associated with each of a plurality of outputs.

20. The phase shifting transformer of claim 1 in which each core leg is provided with at least one winding associated with each output.

21. The phase shifting transformer of claim 10 in which each core leg is provided with at least one winding associated with each of said plurality of outputs.

22. The phase shifting transformer of claim 10 in which each core leg is provided with at least one winding associated with each output.

23. A phase shifting transformer or autotransformer for a three-phase power distribution network, comprising three core legs, and for each phase, a secondary winding comprising a plurality of windings electrically connected in series and distributed amongst the core legs, the secondary winding associated with at least one phase having at least two phase shifted outputs for connection to one phase of the power distribution network, said at least two outputs having a phase shift no greater than 30 degrees, wherein on each core leg the number of turns of windings oriented in one direction is substantially equal to the number of turns of windings oriented in the opposite direction to thereby substantially cancel zero phase sequence harmonics generated by the windings on each core leg.

24. The phase shifting transformer of claim 23 in which each phase is provided with 2, 3, 4 or 5 outputs.

* * * * *